US005775304A

United States Patent [19]

Kono et al.

[11] Patent Number: 5,775,304

[45] Date of Patent: Jul. 7, 1998

[54] HIGH-PRESSURE FUEL INJECTION SYSTEM

[75] Inventors: Hiromi Kono; Toshiyuki Yoshino; Hiroshi Kanai, all of Higashimatsuyama, Japan

[73] Assignee: Zexel Corporation, Tokyo, Japan

[21] Appl. No.: 596,465

[22] Filed: Feb. 5, 1996

[30] Foreign Application Priority Data

Feb. 6, 1995 [JP] Japan ..... 7-039430

[51] Int. Cl.[6] ..... F02M 37/04

[52] U.S. Cl. ..... 123/497; 123/357; 123/494

[58] Field of Search ..... 123/497, 357, 123/494, 358, 359

[56] References Cited

U.S. PATENT DOCUMENTS

| | | | |
|---|---|---|---|
| 4,359,984 | 11/1982 | Nakao | 123/357 |
| 4,576,129 | 3/1986 | Wallenfang | 123/494 |
| 4,788,960 | 12/1988 | Oshizawa | 123/494 |
| 4,893,450 | 1/1990 | Haworth | 123/494 |
| 4,920,942 | 5/1990 | Fujimori et al. | 123/497 |
| 4,982,331 | 1/1991 | Miyazaki | 123/497 |
| 5,379,741 | 1/1995 | Matysiwicz | 123/497 |
| 5,477,833 | 12/1995 | Leighton | 123/497 |
| 5,483,940 | 1/1996 | Namba | 123/497 |

*Primary Examiner*—Carl S. Miller

*Attorney, Agent, or Firm*—Cushman Darby & Cushman IP Group of Pillsbury Madison & Sutro, LLP

[57] ABSTRACT

A high-pressure fuel injection system which has a fuel injection unit including an injector, a fuel pump for supplying a high-pressure fuel to the fuel injection unit, a motor for driving the fuel pump, a PID controller for controlling the operation of the motor, a device for measuring an actual fuel pressure in the fuel injection unit, a device for calculating a deviation of the actual fuel pressure from a predetermined desired fuel pressure and for inputting the deviation to the PID controller as an actuating signal, and a device for calculating a desired fuel injection quantity per injection from input signals indicating an engine speed, an accelerator opening, etc. A manipulated variable which is given as an output from the PID controller is supplied to the motor as an input to control the motor. The system further has a device for calculating an injection quantity per unit time on the basis of the desired injection quantity, and a motor input correcting device which corrects the PID controller itself or the output from it so that the input to be supplied to the motor from the PID controller is corrected on the basis of the calculated per-unit time injection quantity.

17 Claims, 17 Drawing Sheets

1000RPM
ACTUAL FUEL PRESSURE

MOTOR ROTATIONAL SPEED

6000PM
ACTUAL FUEL PRESSURE

MOTOR ROTATIONAL SPEED

PRIOR ART

PRIOR ART
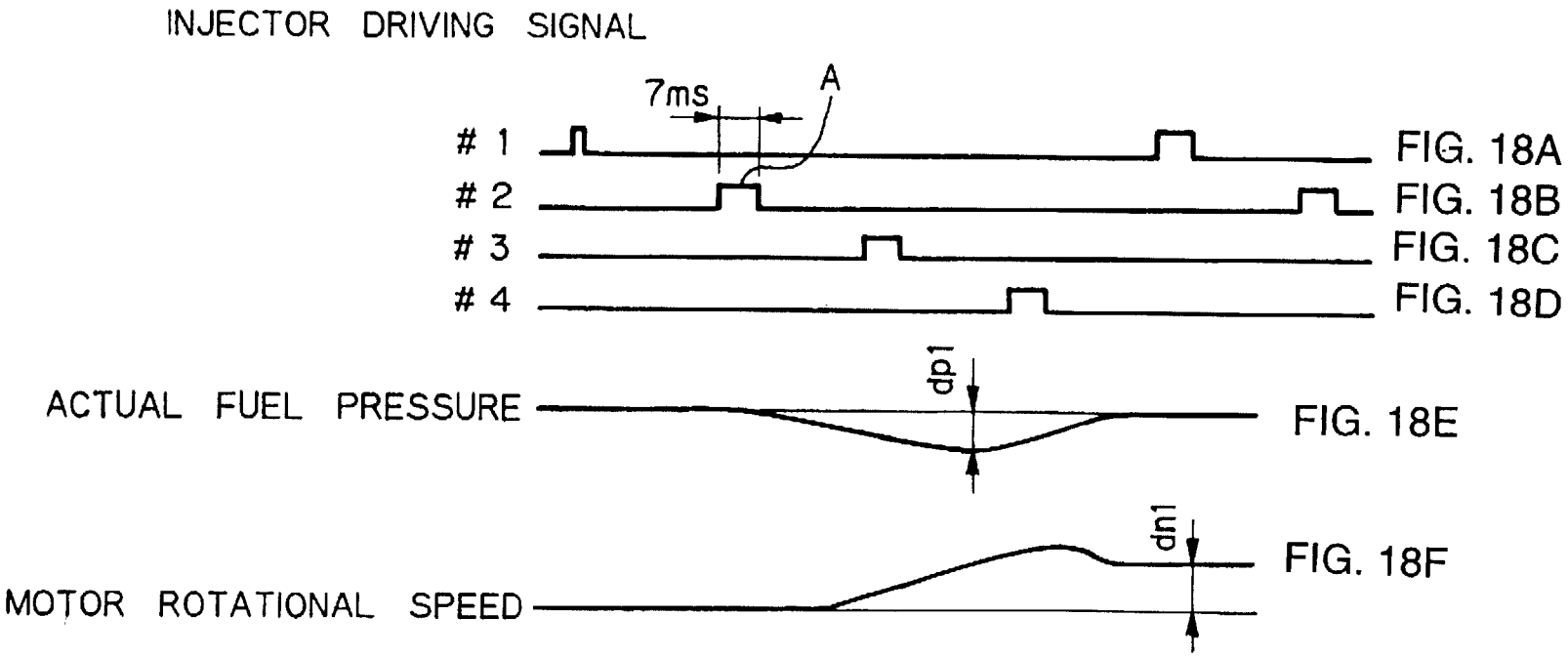

PRIOR ART
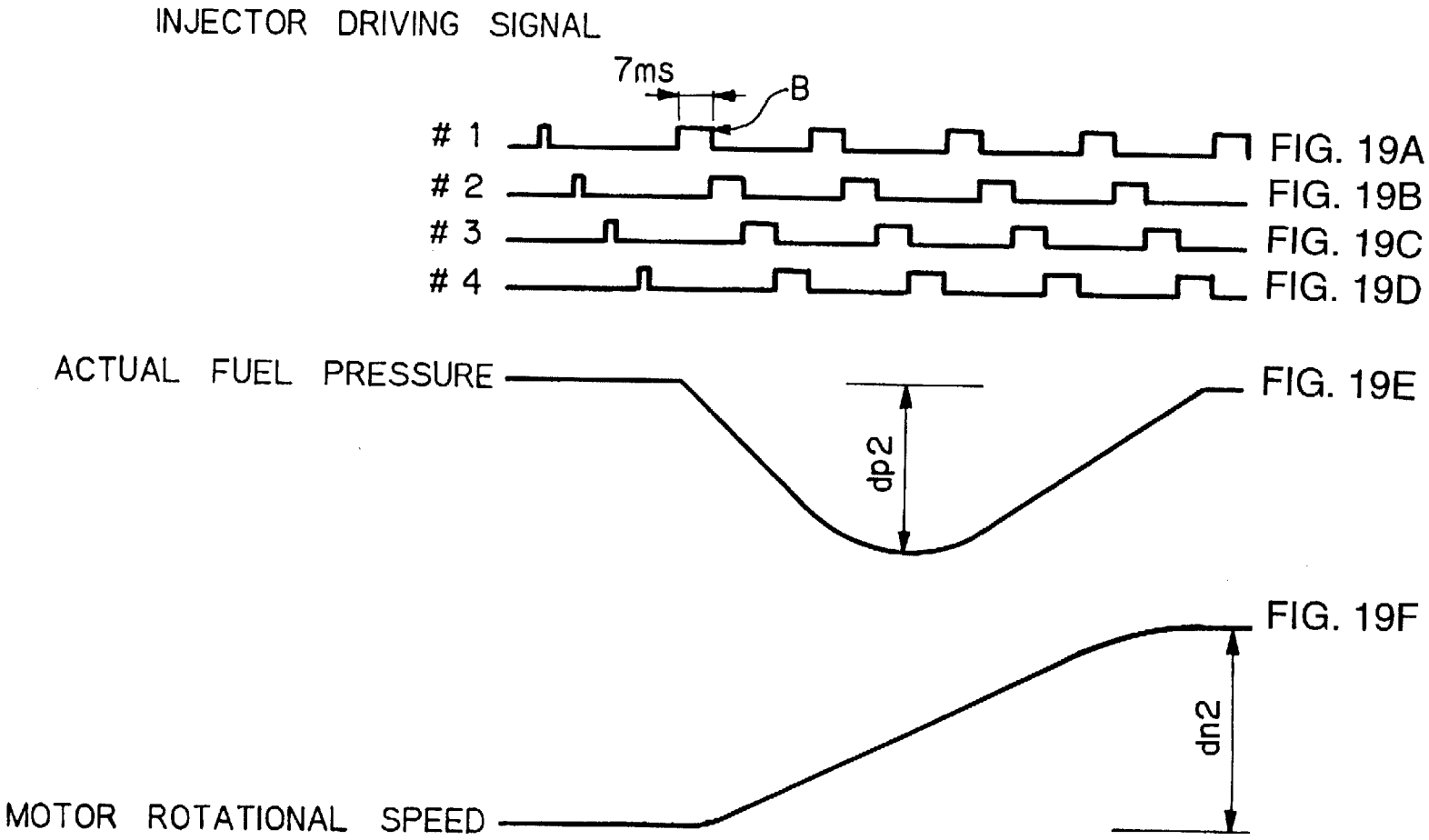

HIGH-PRESSURE FUEL INJECTION SYSTEM

FIELD OF THE INVENTION

The present invention relates to a fuel injection system for an internal combustion engine. More specifically, the present invention relates to a high-pressure fuel injection system in which a fuel pump is driven by a motor, and the operation of the motor is controlled on the basis of the injection quantity per unit time to suppress the pressure fluctuation of fuel injected.

BACKGROUND OF THE INVENTION

There is a conventional fuel injection system for an internal combustion engine in which a fuel pump is driven by a motor to produce a fuel pressure, and the fuel placed under high pressure is injected from an injector. FIG. 16 in the accompanying drawings shows the arrangement of a general fuel injection system according to the conventional technique wherein a fuel pressure is produced by a pump, and the pump is driven by a motor.

Referring to FIG. 16, a fuel pump 1 is driven by a motor 3 to place fuel under high pressure, and the high-pressure fuel is injected from an injector (not shown). The actual pressure Pr of the high-pressure fuel (hereinafter referred to as "actual fuel pressure") is detected with an appropriate pressure sensor, and the detected actual fuel pressure Pr is fed back to a summing circuit 7, with a minus sign put to the actual fuel pressure Pr. In the summing circuit 7, a deviation e of the actual fuel pressure Pr from a desired fuel pressure Pd is obtained and inputted to a proportional plus integral plus derivative action controller (hereinafter referred to as "PID controller" or simply "PID") 5 as a controlled deviation e. The PID controller 5 outputs a manipulated variable Y corresponding to the controlled deviation e to the motor 3 to control the rotation of the motor 3, thereby controlling the actual fuel pressure. On the other hand, a desired injection quantity Q per injection is calculated from information such as the opening of the accelerator, the engine speed, etc., and in general, the injection period of the injector is controlled according to the desired injection quantity Q, thereby injecting a desired amount of fuel.

Incidentally, a fuel injection system having the above-described arrangement suffers from the problem that the responsivity of the control system may change according to the fuel injection quantity, resulting in a failure to effect appropriate fuel pressure control. That is, if the gain of the PID controller has been adjusted to a small fuel injection quantity, when the fuel injection quantity increments by a relatively small amount in a state where the fuel pressure is stable, the actual fuel pressure once reduces and then rapidly returns to the desired fuel pressure, as shown in FIG. 17A. However, when the increment of the fuel injection quantity is large, the actual fuel pressure reduces to a considerable extent because of the delay in follow-up of the motor, and the time required for the actual fuel pressure to return to the desired fuel pressure also lengthens, as shown in FIG. 17B. On the other hand, if the gain of the PID controller has been set in conformity to a large fuel injection quantity, even when the increment of the fuel injection quantity is large, the actual fuel pressure begins to recover before the reduction of the actual fuel pressure becomes large, and it returns to the desired fuel pressure relatively rapidly, as shown in part (d) of FIG. 17D. However, if the increment of the fuel injection quantity is small, the gain works excessively, causing hunting to occur in the response, as shown in part (c) of FIG. 17C. Consequently, a long time is required for the actual fuel pressure to be stabilized at the desired fuel pressure.

The problems associated with the conventional technique will be explained below more specifically with reference to FIGS. 18A–19F by way of an example in which the gain of the PID controller has been adjusted to a small fuel injection quantity as in the case of FIGS. 17A and 17B. FIG. 18A–18F show a control process in a case where the desired fuel injection quantity Q has increased as a result of stepping on of the accelerator, for example, when a four-cylinder engine is rotating at a relatively low engine speed, e.g. 1,000 rpm, and the injection period of the injectors has correspondingly increased to 7 ms, for example, from the injection indicated by reference symbol A in FIG. 18B. In this case, even if the injection quantity per injection increases, the injection quantity q per unit time does not increase so rapidly because the engine speed is relative low. Accordingly, there is no very rapid increase in the amount of fuel to be supplied from the fuel pump to the fuel injection unit, and the required change dn1 of the motor rotational speed is also small. Therefore, the motor can reach the desired rotational speed within an extremely short time, and the reduction dp1 of the actual pressure of the fuel injected is also small. Moreover, the actual fuel pressure can be rapidly restored to the desired fuel pressure.

FIGS. 19A–19F show a control process in a case where the desired fuel injection quantity Q has increased when the engine is rotating at a relatively high speed, e.g. 6,000 rpm, and the injection period of the injectors has also increased to 7 ms from the injection indicated by reference symbol B in FIG. 19A. In this case, the injection quantity per injection is the same as in the case of FIGS. 18A–18F. However, because of the high engine speed, the injection quantity q per unit time is exceedingly large in comparison to the case of FIGS. 18A–18F. Accordingly, there is a rapid increase in the amount of fuel to be supplied to the fuel injection unit from the fuel pump per unit time, and the required increment dn2 of the motor rotational speed also becomes large. Consequently, the motor reaches the desired rotational speed after a considerable delay, and the injection of a large amount of fuel continues during the delay time. As a result, the reduction dp2 of the actual fuel pressure increases, and a great deal of time Is required for the actual fuel pressure to return to the desired fuel pressure.

Such a large fluctuation of the actual fuel pressure makes it impossible to inject the desired amount of fuel, and also increases the particle size variation of fuel injected. Accordingly, it becomes impossible to obtain optimum combustion.

SUMMARY OF THE INVENTION

In view of the above-described problems of the background art, the present invention provides a high-pressure fuel injection system which has a fuel injection unit including an injector, a fuel pump for supplying a high-pressure fuel to the fuel injection unit, a motor for driving the fuel pump, a PID controller for controlling the operation of the motor, a device for measuring an actual fuel pressure in the fuel injection unit, a device for calculating a deviation of the actual fuel pressure from a predetermined desired fuel pressure and for inputting the deviation to the PID controller as an actuating signal, and a device for calculating a desired fuel injection quantity per injection from input signals indicating an engine speed, an accelerator opening, and so forth. The high-pressure fuel injection system further has a device for calculating an injection quantity per unit time on the basis of the desired injection quantity, and a device for correcting an input to be given to the motor from the PID controller on the basis of the calculated per-unit time injection quantity.

In an embodiment of the present invention, the motor input correcting device includes a device for correcting the gain factors of the PID controller on the basis of the calculated per-unit time injection quantity.

In another embodiment of the present invention, the motor input correcting device includes a device for correcting an output delivered from the PID controller by calculating a correction quantity on the basis of the calculated per-unit time injection quantity and adding the correction quantity to the output from the PID controller.

In still another embodiment of the present invention, the motor input correcting device includes a device for correcting the gain factors of the PID controller on the basis of the calculated per-unit time injection quantity, and a device for correcting an output delivered from the PID controller by calculating a correction quantity on the basis of the calculated per-unit time injection quantity and adding the correction quantity to the output from the PID controller.

In a further embodiment of the present invention, the high-pressure fuel injection system further has an injection control device for controlling the injection period of the injector according to the desired injection quantity, and an actual injection period correcting device for correcting the injection period of the injector on the basis of the actual fuel pressure in the fuel injection unit measured by the pressure measuring device. The injection control device controls the injector on the basis of the corrected actual injection period.

A principal feature of the present invention resides in the provision of a high-pressure fuel injection system which is capable of minimizing the fluctuation of the fuel pressure independently of the fuel injection quantity per unit time and independently of the amount of change of the fuel injection quantity per unit time.

Another feature of the present invention resides in the provision of a high-pressure fuel injection system which is capable of injecting fuel with a minimal fuel particle size variation and hence capable of obtaining optimum combustion.

Still another feature of the present invention resides in the provision of a high-pressure fuel injection system which is capable of minimizing the fuel pressure fluctuation independently of the fuel injection quantity per unit time and independently of the amount of change of the fuel injection quantity per unit time by correcting the gain factors of a PID controller that controls a motor for driving a fuel pump.

A further feature of the present invention resides in the provision of a high-pressure fuel injection system which is capable of minimizing the fuel pressure fluctuation independently of the fuel injection quantity per unit time and independently of the amount of change of the fuel injection quantity per unit time by adding a correction quantity to an output delivered from a PID controller that controls a motor for driving a fuel pump, thereby correcting the output from the PID controller.

A still further feature of the present invention resides in the provision of a high-pressure fuel injection system in which an actual injection period correcting device corrects the injection period of an injector, which is calculated from a desired injection quantity, on the basis of a measured actual fuel pressure, and an injection control device controls the injector on the basis of the corrected actual injection period.

Other features and advantages of the present invention will become clear to those skilled in the art from the following detailed description, taken in connection with the accompanying drawings, and the appended claims.

BRIEF DESCRIPTION OF THE DRAWINGS

FIGS. 18A–18F and 19A–19F are two sets of charts showing in more detail the results of fuel pressure control by the conventional technique shown in FIG. 16.

DESCRIPTION OF THE PREFERRED EMBODIMENTS

Preferred embodiments of the present invention will be described below with reference to the accompanying drawings. It should be noted, however, that the present invention is not necessarily limited to the structures or arrangements shown in the following description or the accompanying drawings, and that various changes and modifications may be made in the present invention without departing from the scope of the appended claims. Also, it should be understood that the terms and expressions employed herein are for the purpose of description and not of limitation.

Figure 1:
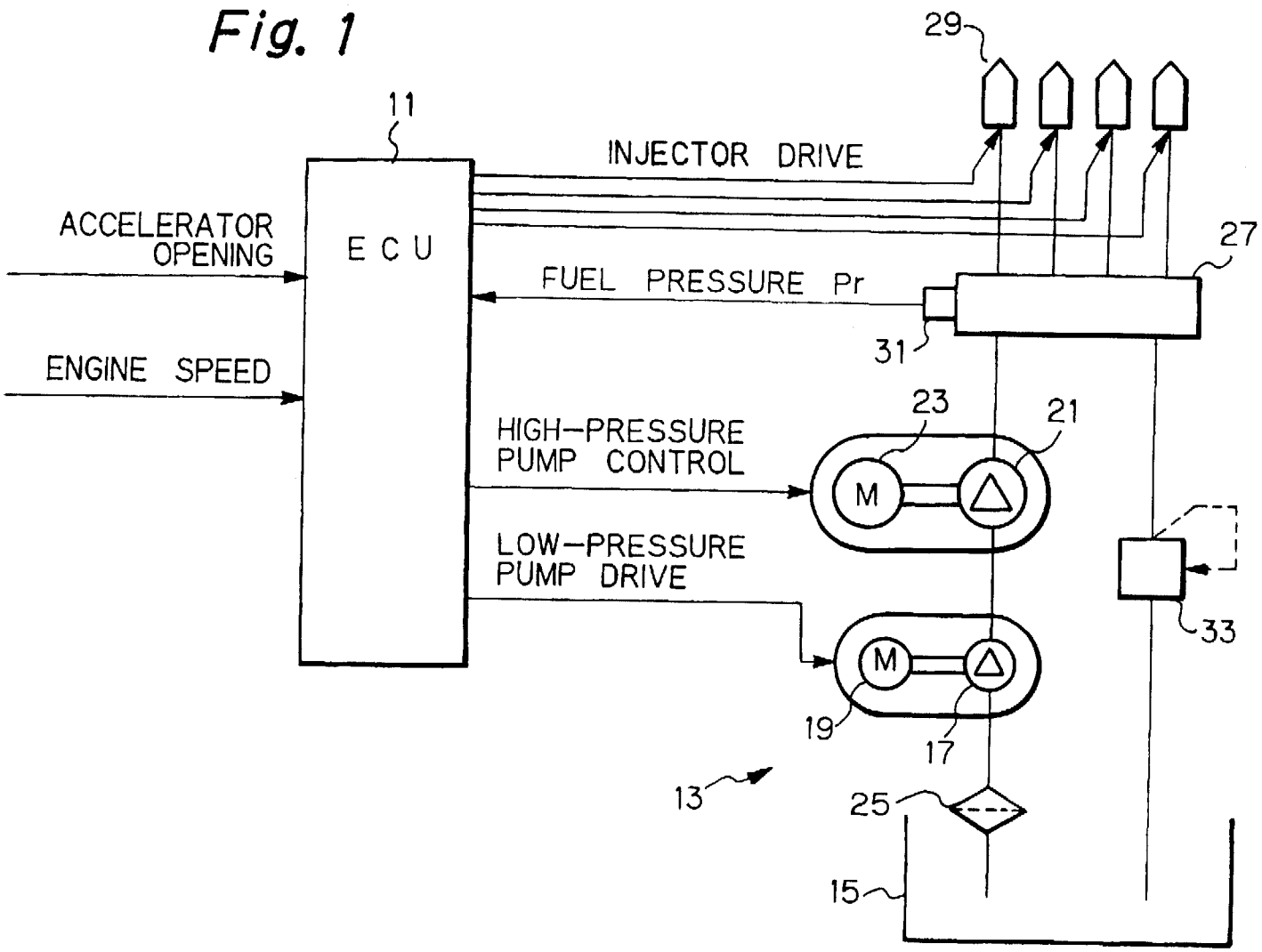
FIG. 1 Is a block diagram showing a high-pressure fuel injection system according to the present invention.

FIG. 1 is a block diagram showing a high-pressure fuel injection system according to the present invention. In the figure, an electronic control unit (ECU) 11 is supplied with various input signals from various sensors (not shown), including signals indicating an accelerator opening and an engine speed. The ECU 11 controls fuel injection, fuel pressure, etc. (explained later) on the basis of these input signals. The ECU 11 includes an appropriate CPU, ROM, RAM, I/O ports, etc. and constitutes a desired injection quantity calculating device, a per-unit time injection quantity calculating device, a PID controller, an injection control device, etc., which will be explained later. A fuel supply system 13 includes a fuel tank 15, a combination of a low-pressure pump 17 and a motor 19 for driving the low-pressure pump 17, a combination of a high-pressure pump 21 and a motor 23 for driving the high-pressure pump 21, and a filter 25. Fuel in the fuel tank 15 is pumped out by the low-pressure pump 17 through the filter 25 and then placed under high pressure by the high-pressure pump 21. The high-pressure fuel is sent to a common rail 27 which is a pipe-shaped closed container constituting a part of a fuel injection unit. The common rail 27 is adapted to be capable of absorbing a pressure fluctuation of fuel in it to a certain extent. Injectors 29 are connected to the common rail 27. Each injector 29 is controlled by an injector driving signal from the ECU 11 so as to inject high-pressure fuel at appropriate timing. A pressure sensor 31 is attached to the common rail 27. The pressure sensor 31 measures the pressure of the fuel in the common rail 27, that is, the actual pressure of the fuel injected from each injector 29, i.e. actual fuel pressure Pr, and inputs a signal indicating the measured actual fuel pressure Pr to the ECU 11. A relief valve 33 returns the fuel to the fuel tank 15 when the actual fuel pressure Pr in the common rail 27 exceeds a set desired fuel pressure Pd, thereby regulating the fuel pressure in the common rail 27 so that it does not exceed the desired fuel pressure Pd.

Figure 2:
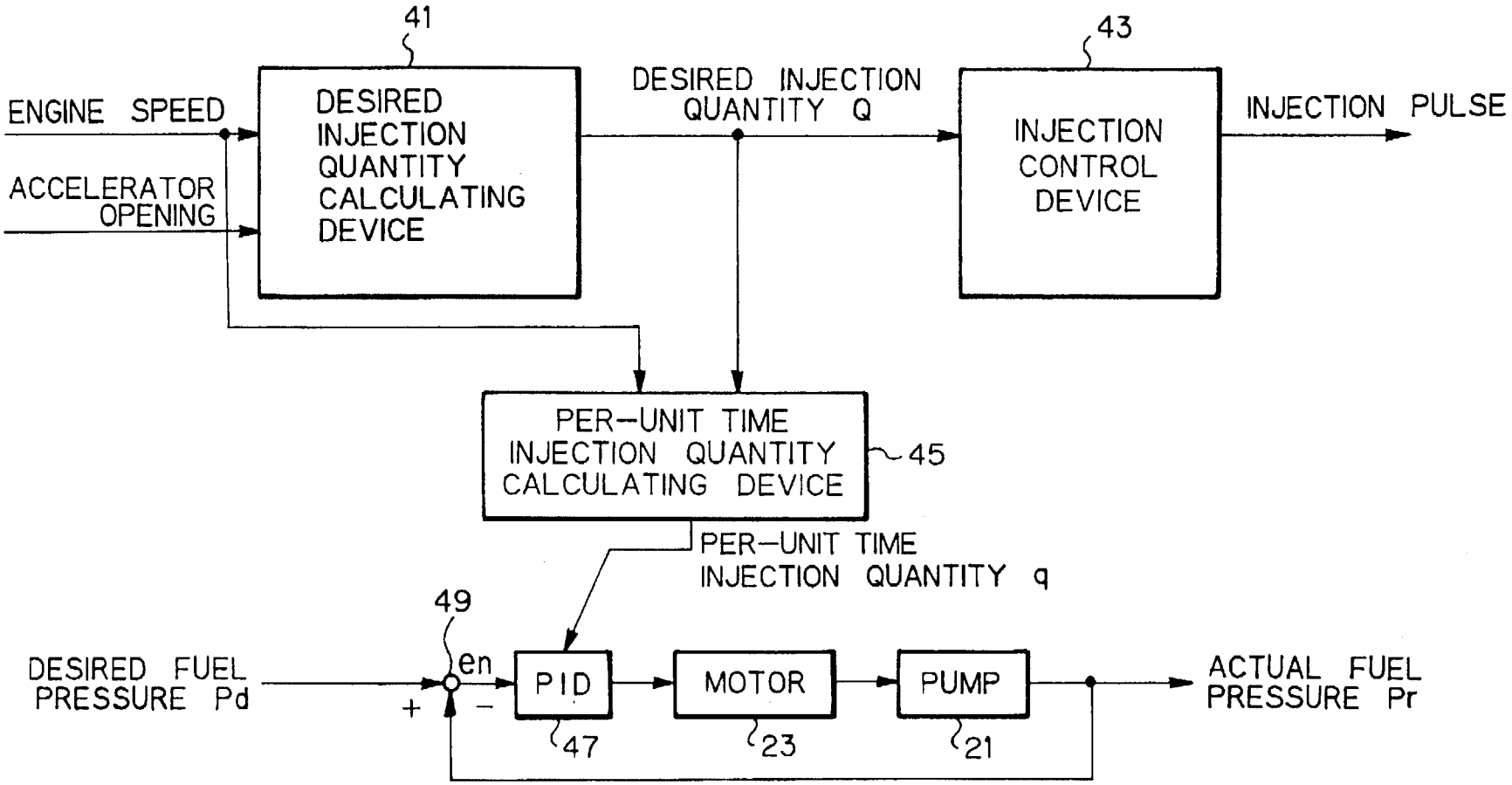
FIG. 2 is a block diagram showing a first embodiment of the present invention.

FIG. 2 is a block diagram showing the arrangement of a fuel injection system according to a first embodiment of the present invention. FIG. 2 shows only principal constituent elements required for explanation of this embodiment. A desired injection quantity calculating device 41 calculates an amount of fuel to be injected from each injector 29 per injection, that is, a desired injection quantity Q, on the basis of the engine speed and the accelerator opening, which are inputted from the sensors (not shown). The calculated desired injection quantity Q is inputted to an injection control device 43, and the injection control device 43 sends injection pulses to the injectors 29 at appropriate timing to control the injection operation of the injectors 29.

In this embodiment also, a fuel pump 21 (i.e. the high-pressure pump in FIG. 1) is driven by a motor 23, and a deviation e of the actual fuel pressure Pr, detected by the pressure sensor 31, from the desired fuel pressure Pd is inputted to a PID controller 47 as a controlled deviation, thereby controlling the motor 23 to effect fuel pressure control.

The above-described arrangement is similar to the arrangement of the conventional high-pressure fuel injection system. This embodiment is characterized by further having a device for calculating an injection quantity per unit time, which is denoted by reference numeral 45 in FIG. 2. The per-unit time injection quantity calculating device 45 is supplied with input signals indicating the engine speed and the above-described desired injection quantity Q, and calculates an amount of fuel to be injected from injectors 29 per unit time, that is, a per-unit time injection quantity q, from the input values. On the basis of the calculated per-unit time injection quantity q, the gain factors of the PID controller are corrected as described later.

Figure 3:
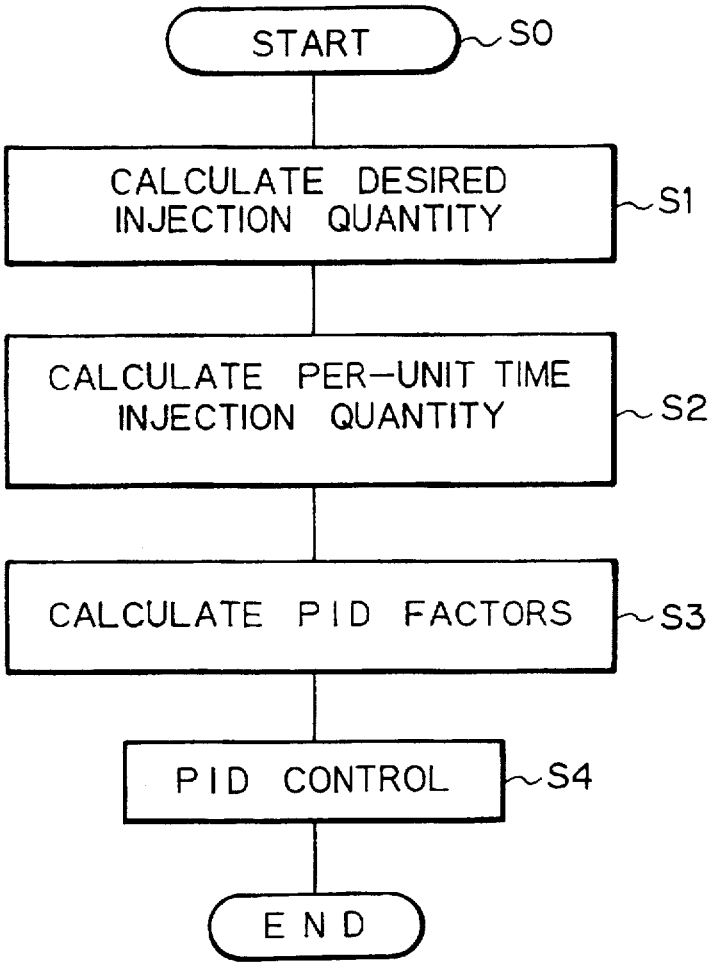
FIG. 3 is a flowchart showing a fuel pressure control task executed in the first embodiment.

FIG. 3 is a flowchart showing a fuel pressure control task for effecting the above-described fuel pressure control. The fuel pressure control task is executed every 10 ms, for example. The task starts at S0, and a desired injection quantity Q is calculated by the desired injection quantity calculating device 41 at step S1. Next, a per-unit time injection quantity q is calculated by the per-unit time injection quantity calculating device 45 at step S2. Next, gain factors to be given to the PID controller 47 are calculated at step S3. That is, FIG. 4 is charts showing gain factors P, i and D which are to be given to the PID controller 47 according to each individual per-unit time injection quantity q. These charts are experimentally obtained and stored as data in the RAM of the ECU 11 in advance. At step S3, gain factors P, i and D relative to the per-unit time injection quantity q are calculated on the basis of the injection quantity q obtained at step S2, and the gain factors so far used in the PID controller 47 are replaced by the newly obtained values, thereby being corrected. Next, PID control is effected by using the gain factors corrected at step S4. That is, the deviation $e_n$ of the actual fuel pressure Pr from the desired fuel pressure Pd is inputted to the PID controller 47, and an output Y given by the following expression (1) is inputted to the motor 23 as a manipulated variable:

$$Y = P \cdot e_n + \sum_{x=1}^{n} i \cdot e_x + D \cdot (e_n - e_{n-1}) \tag{1}$$

where n is the repeat count of the fuel pressure control task.

As will be clear from the foregoing description, in this embodiment the motor input correcting device is given in the form of a gain factor correcting device, and an input which is to be given to the motor is corrected by correcting the gain factors of the PID through the gain factor correcting device.

Figure 4C:
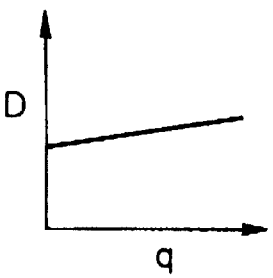
FIGS. 4A–4C are a set of charts showing the relationship between the injection quantity per unit time and the gain factors of a PID controller, which are used in fuel pressure control carried out in the first embodiment.
Figure 4B:
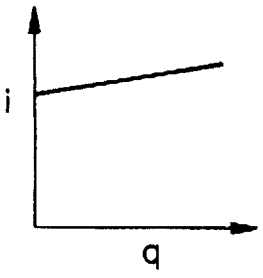
Figure 4A:
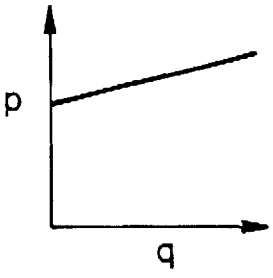
Figures 5A, 5B, 5C, 5D:
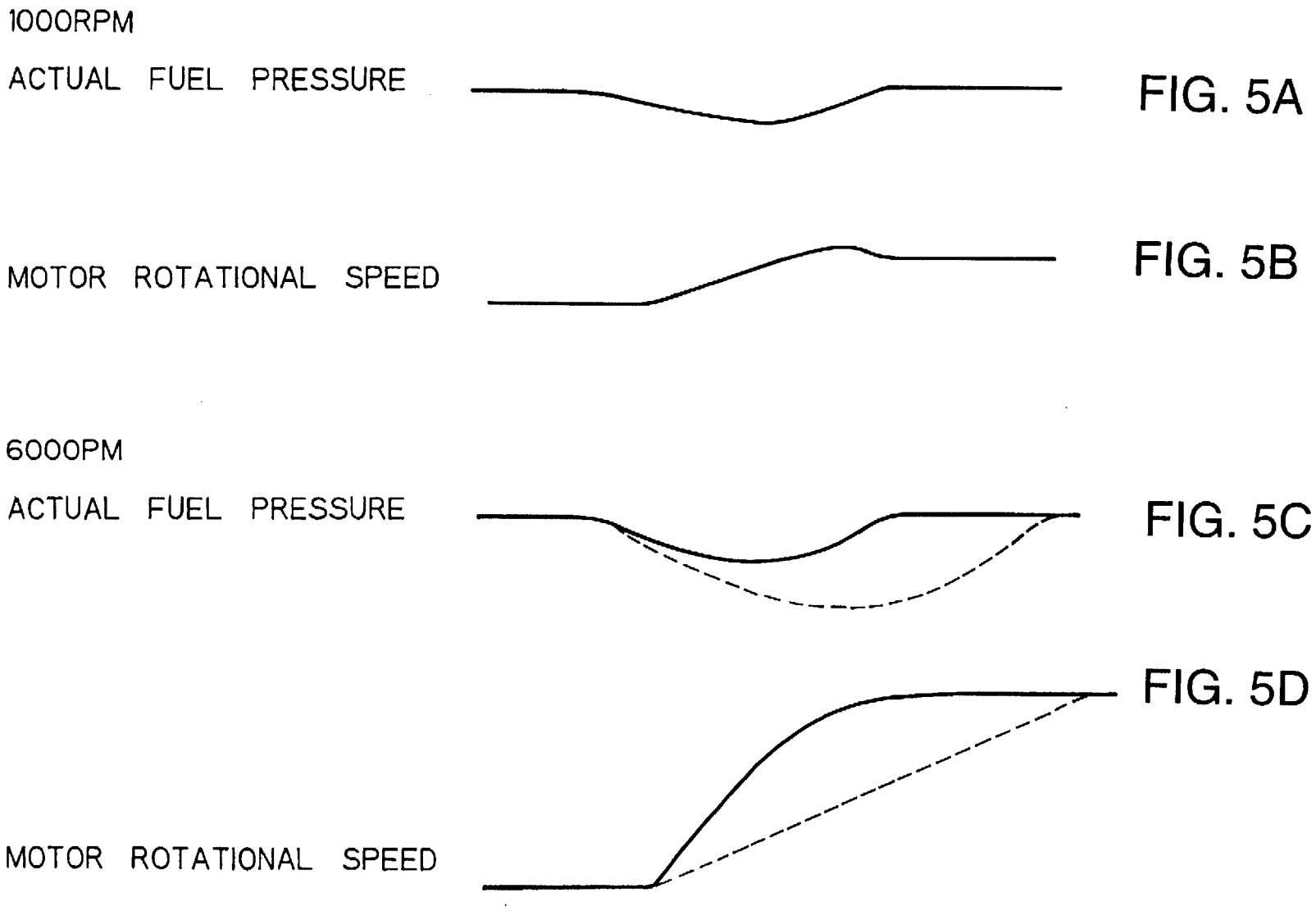
FIGS. 5A–5D are a set of charts showing the results of fuel pressure control by the first embodiment.

As will be clear from FIGS. 4A–4C, in the present invention the values of the gain factors P, i and D, which are obtained according to the per-unit time injection quantity q, are set so as to increase as the injection quantity q increases, and the PID controller 47 is given an optimum gain according to each individual per-unit time injection quantity q. Accordingly, as shown in FIGS. 5A–5D, when the per-unit time injection quantity q is small, the PID control is effected with a small gain, thus enabling the actual fuel pressure Pr to be rapidly restored to the desired fuel pressure Pd without causing hunting (see FIGS. 5A and 5B. When the per-unit time injection quantity q is large, on the other hand, the PID control is effected with a large gain, thereby shortening the rise time in the response of the motor 23, and thus allowing the rotational speed of the motor 23 to approach the desired rotational speed before the reduction of the actual fuel pressure Pr increases. In this way, the actual fuel pressure Pr is restored to the desired fuel pressure Pd while the reduction of the actual fuel pressure Pr is still small, thereby minimizing the reduction of the fuel pressure and rapidly restoring the actual fuel pressure Pr to the desired fuel pressure Pd (see FIGS. 5C and 5D. Although in this embodiment the gain factors P, i and D relative to the per-unit time injection quantity q are given by linear curves, it should be noted that curves for the gain factors P, i and D are not necessarily limited to the linear curves, and that the gain factors P, i and D may also be given by quadratic or higher-order curves. The dashed lines in FIGS. 5C and 5D represent the response in the case of the conventional technique.

Figure 6:
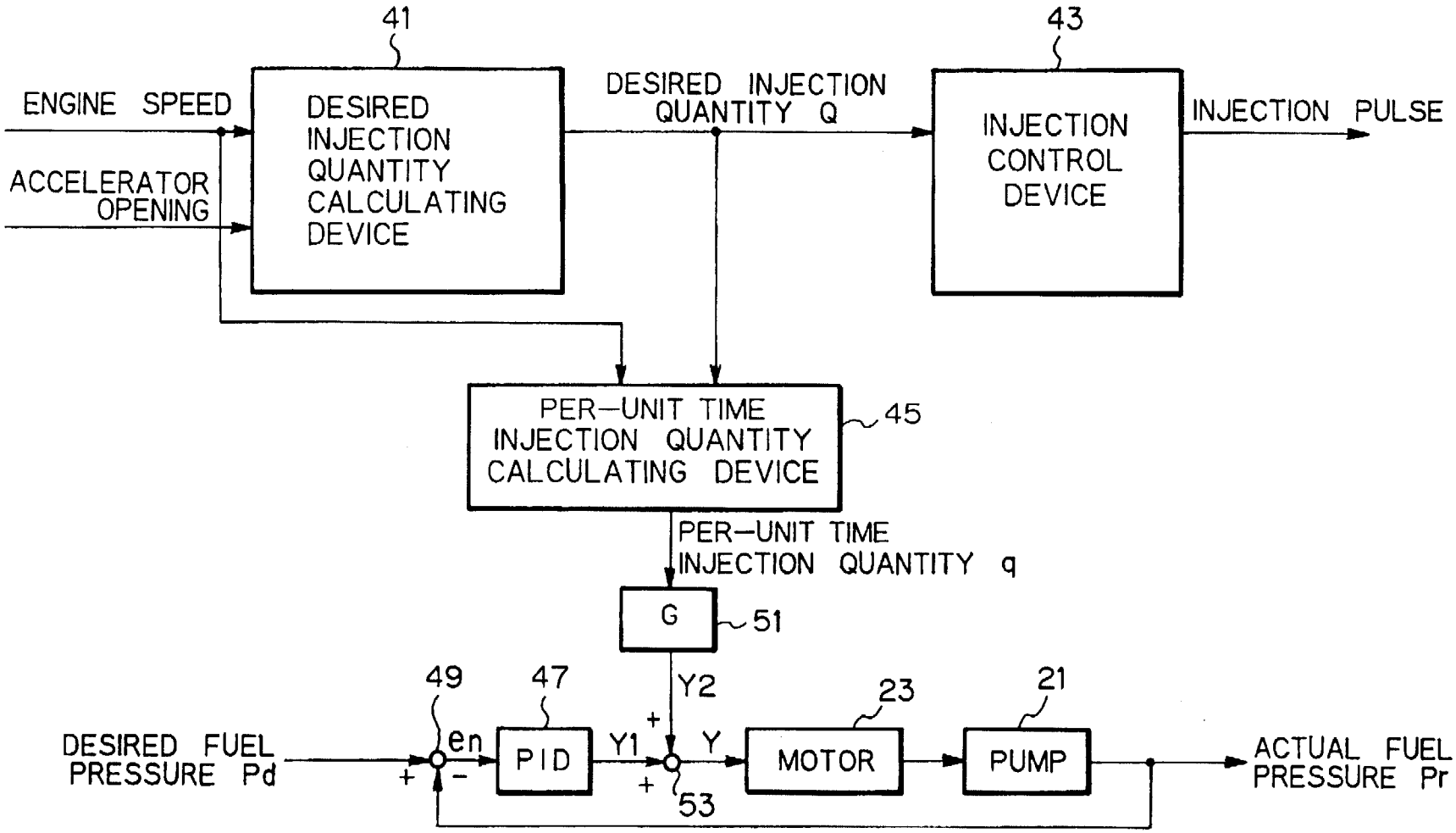
FIG. 6 is a block diagram showing a second embodiment of the present invention.

FIG. 6 is a block diagram showing a second embodiment of the present invention. In the above-described first embodiment, the gain of the PID controller is corrected according to the per-unit time injection quantity q, whereas, in the second embodiment, an input which is to be given to the motor is corrected by employing feed-forward control based on the per-unit time injection quantity q.

Figure 8:
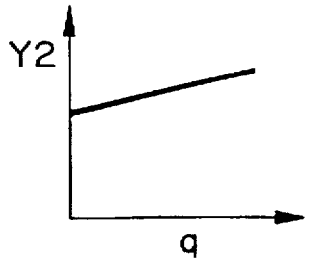
FIG. 8 is a chart showing the relationship between the injection quantity per unit time and the correction quantity, which is used in fuel pressure control carried out in the second embodiment.

That is, in this embodiment, the gain of the PID controller 47 is invariable as in the case of the above-described conventional technique. The actual fuel pressure Pr detected by the pressure sensor 31 is fed back to a summing circuit 49 where a deviation $e_n$ of the actual fuel pressure Pr from the desired fuel pressure Pd is obtained and inputted to the PID controller 47. The PID controller 47 effects PID control based on the above expression (1) and outputs a manipulated variable Y1 as a result of the PID control. In this embodiment, the system has a corrective circuit G 51 as a PID output correcting device. More specifically, the corrective circuit G 51 is given a per-unit time injection quantity q as an input, and calculates a correction quantity Y2 corresponding to each individual per-unit time injection quantity q. The correction quantity Y2 is calculated on the basis of a chart as shown FIG. 8. The chart is experimentally obtained and stored as data in the RAM of the ECU 11 in advance. As will be clear from FIG. 8, in this embodiment the correction quantity Y2 is set so as to increase as the per-unit time injection quantity q increases. The correction quantity Y2 is added to the manipulated variable Y1 in a summing circuit 53, and the thus corrected output Y is inputted to the motor 23. As will be clear from the foregoing description, in this embodiment the PID output correcting device constitutes a motor input correcting device.

Figure 7:
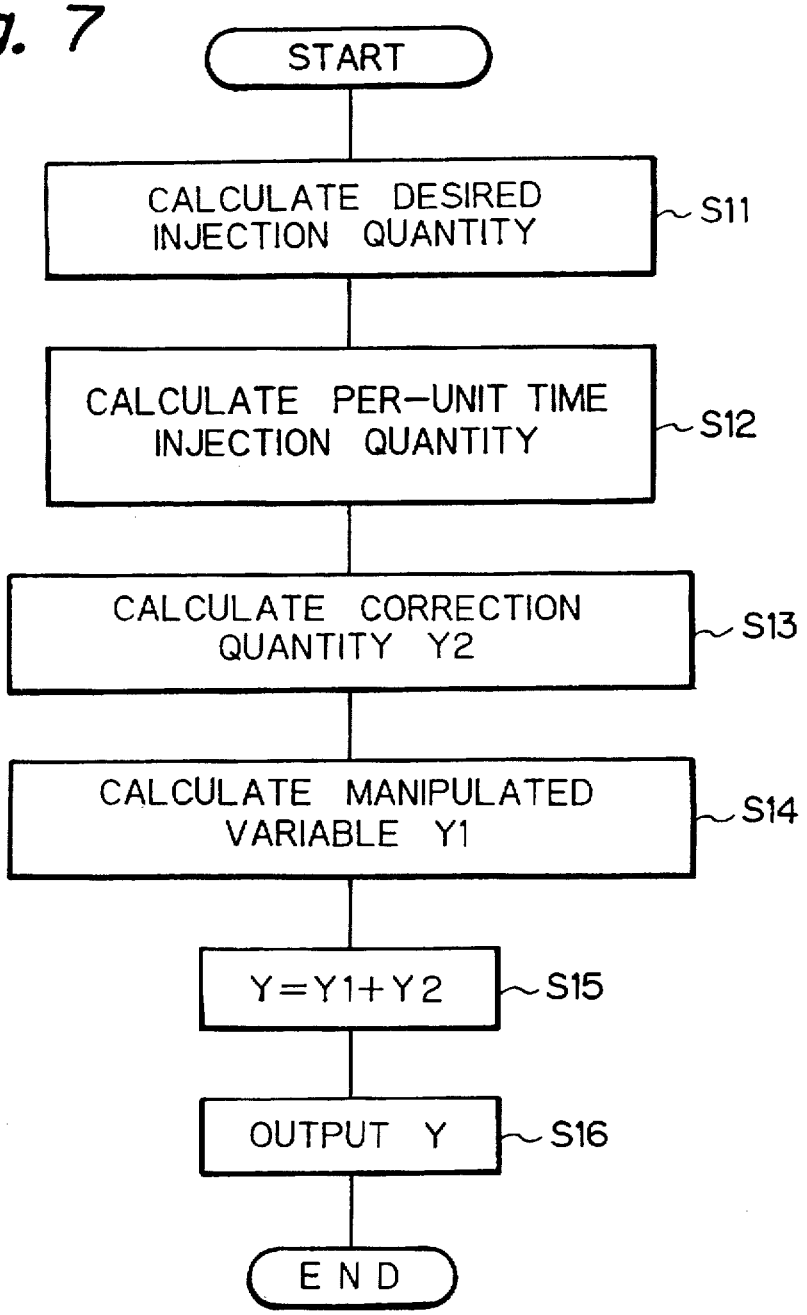
FIG. 7 is a flowchart showing a fuel pressure control task executed in the second embodiment.

FIG. 7 is a flowchart showing a fuel pressure control task executed in this embodiment. At step S11, a desired injection quantity Q per injection is calculated. A per-unit time injection quantity q is calculated from the calculated desired injection quantity Q and the engine speed at step S12. Next, a correction quantity Y2 is calculated by the corrective circuit G 51 at step S13, and a manipulated variable Y1 is outputted from the PID controller 47 at step S14. The manipulated variable Y1 and the correction quantity Y2 are added together at step S15 to obtain a corrected input Y which is to be given to the motor 23, and the input Y is inputted to the motor 23 at step S16.

Thus, in this embodiment, a manipulated variable which is to be outputted from the PID controller to the motor can be corrected on the basis of a correction quantity from the corrective circuit G 51 by an appropriate amount according to the per-unit time injection quantity q. Therefore, it is possible to obtain advantageous effects similar to those in the first embodiment. It should be noted that a factor by which the output Y1 of the PID is to be multiplied may be calculated in place of the correction quantity Y2; this is equivalent to the addition of a certain correction quantity to Y1.

Figure 9:
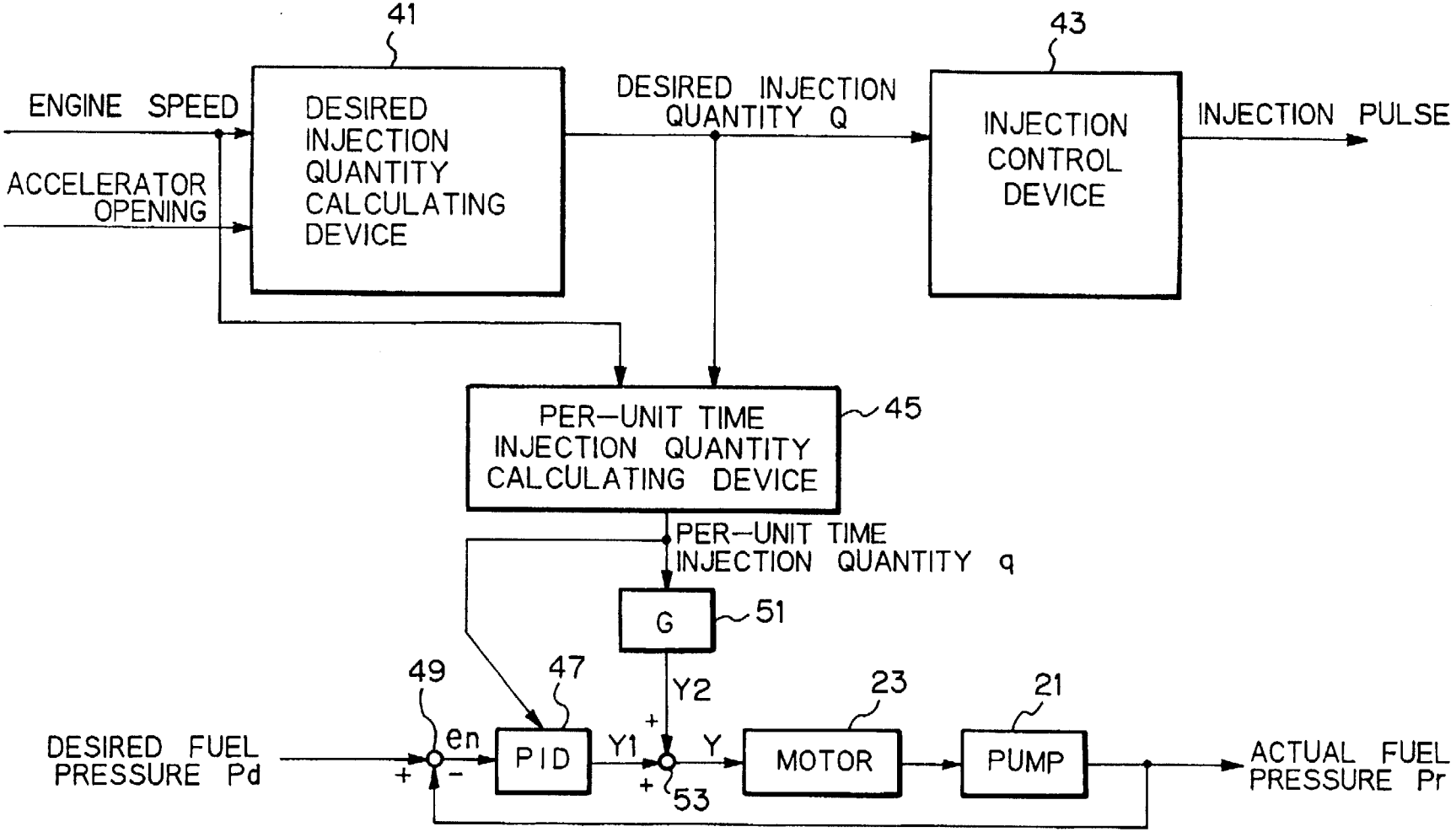
FIG. 9 is a block diagram showing a third embodiment of the present invention.
Figure 10:
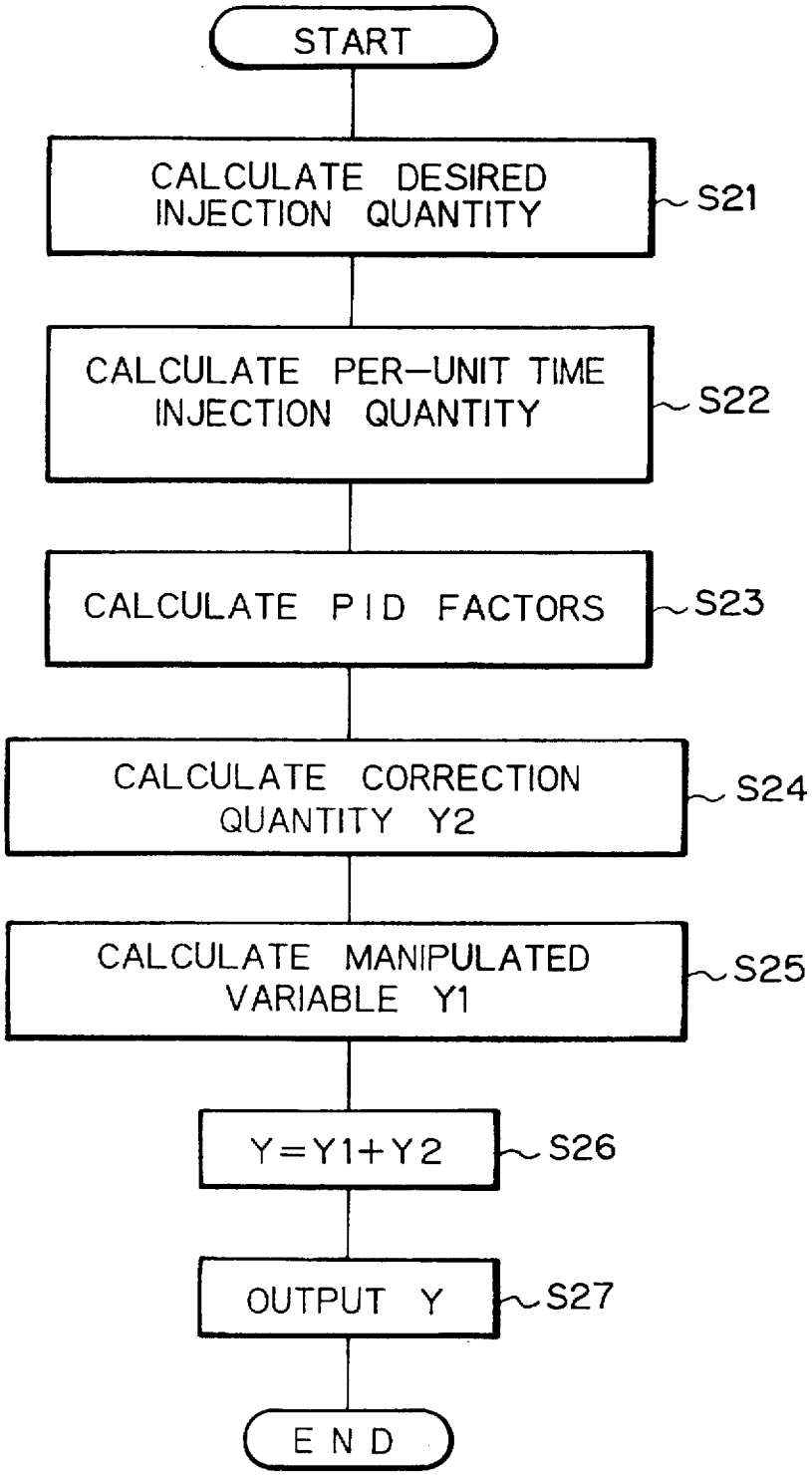
FIG. 10 is a flowchart showing a fuel pressure control task executed in the third embodiment.

FIG. 9 is a block diagram showing a third embodiment which is a combination of the first and second embodiments. FIG. 10 is a flowchart showing a fuel pressure control task executed in the third embodiment. In this embodiment, the corrective circuit G 51 delivers an output Y2 as a correction quantity on the basis of a per-unit time injection quantity q calculated in the per-unit time injection quantity calculating device 45. On the other hand, the gain factors of the PID controller 47 are corrected as has been described in regard to the first embodiment, and the PID controller 47 delivers an output Y1 on the basis of the corrected gain factors. The outputs Y1 and Y2 are added together in the summing circuit 53, and the thus corrected input Y is given to the motor 23. Further description of this embodiment is omitted because it may be readily understood from the above description of the first and second embodiments.

Figure 11:
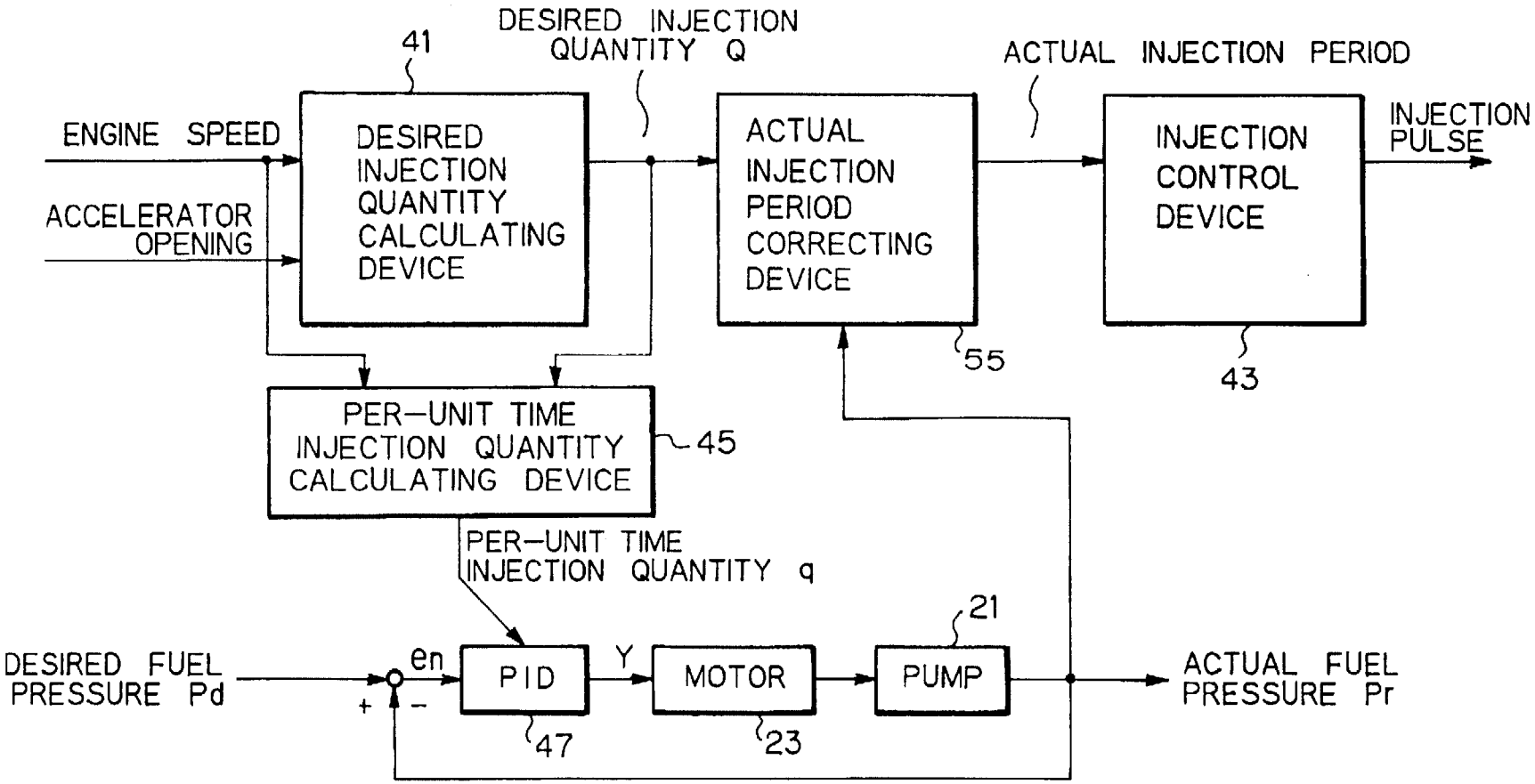
FIG. 11 is a block diagram showing a fourth embodiment of the present invention.
Figure 12:
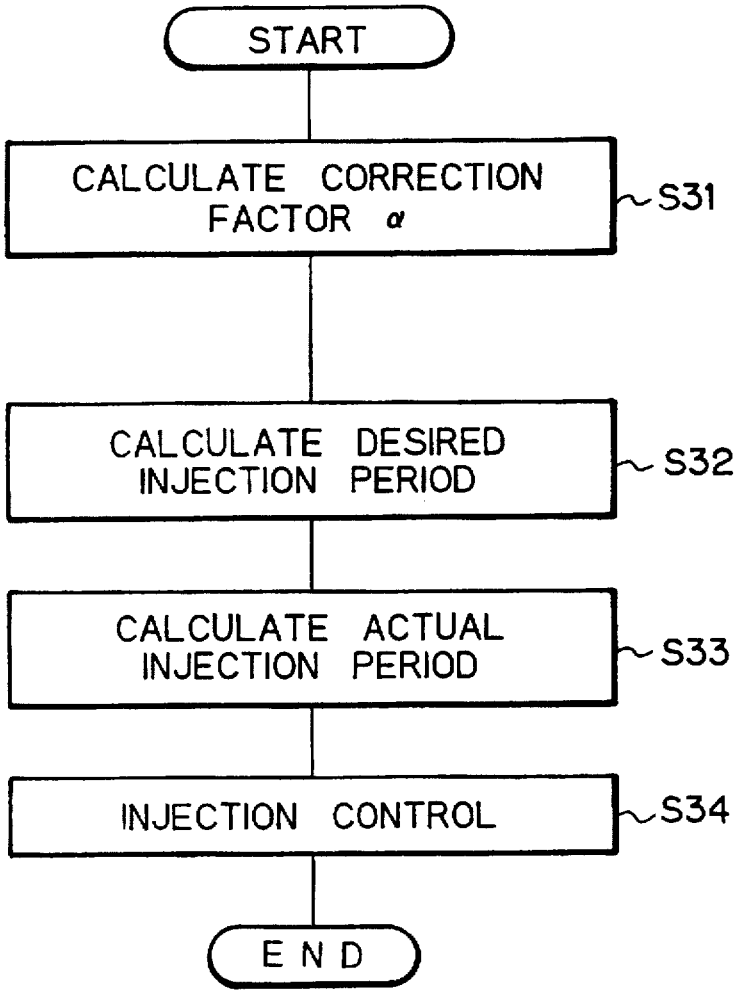
FIG. 12 is a flowchart showing an injection control task executed in the fourth embodiment.
Figure 13:
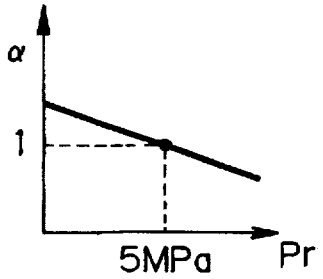
FIG. 13 is a chart showing the relationship between the injection quantity per unit time and the correction factor, which is used in the fourth embodiment.

Referring to FIGS. 11 to 13, a fourth embodiment of the present invention will be described below. The feature of the fourth embodiment resides in that injection control that is corrected on the basis of the per-unit time injection quantity q is effected in addition to the fuel pressure control based on the per-unit time injection quantity q, carried out in the first embodiment.

That is, the above-described fuel pressure control of high-pressure fuel, which is based on the per-unit time injection quantity q, makes it possible to minimize the fluctuation of the fuel pressure, but it is difficult to completely eliminate the fuel pressure fluctuation. In general, injection control is effected by controlling the injection period of an injector. However, if the fuel pressure fluctuates, the amount of fuel injected from the injector also changes. Accordingly, if injection control is effected on the basis of the calculated desired injection quantity Q only, the desired amount of fuel cannot be injected. Therefore, in this embodiment, injection control is corrected on the basis of the per-unit time injection quantity q.

FIG. 11 is a block diagram showing the fourth embodiment. In the above-described first embodiment, a signal indicting a desired injection quantity Q, which is calculated by the desired injection quantity calculating device 41 from the accelerator opening and the engine speed, is inputted to the injection control device 43 as it is, and injection pulses for opening the injectors 29 for a time period corresponding to the desired injection quantity Q are given from the injection control device 43 to the injectors 29. In this embodiment, the system further has an actual injection period correcting device 55. The actual injection period correcting device 55 is supplied with a desired injection quantity Q calculated by the desired injection quantity calculating device 41 and an actual fuel pressure Pr detected by the pressure sensor 31 as input signals. The actual injection period correcting device 55 calculates a factor $\alpha$ for correcting the injection period on the basis of the detected actual fuel pressure Pr by using a chart as shown in FIG. 13, and corrects the actual injection period by using the correction factor $\alpha$. Then, a signal corresponding to the thus corrected actual injection period is given to the injection control device 43, and injection pulses corresponding to the corrected actual injection period are given from the injection control device 43 to the injectors 29.

FIG. 12 is a flowchart showing a fuel pressure control task for effecting the above-described injection control. At step S31, a correction factor $\alpha$ is calculated by using the chart of FIG. 13 on the basis of the actual fuel pressure Pr from the pressure sensor 31. The chart is experimentally obtained and stored as data in the RAM of the ECU in advance. In this embodiment, the correction factor Cr is represented by a linear curve, and it is set so as to assume the value 1 when the actual fuel pressure Pr is 5Mpa (megapascal), for example, and to increase as the actual fuel pressure Pr reduces from that value. It should be noted, however, that this is merely an example, and that the present invention is not necessarily limited thereto. Next, a desired injection period is calculated from the desired injection quantity at step S32, and the desired injection period is multiplied by the correction factor $\alpha$ to obtain an actual injection period at step S33. Then, injection control is effected on the basis of the calculated actual injection period at step S34.

Figure 14:
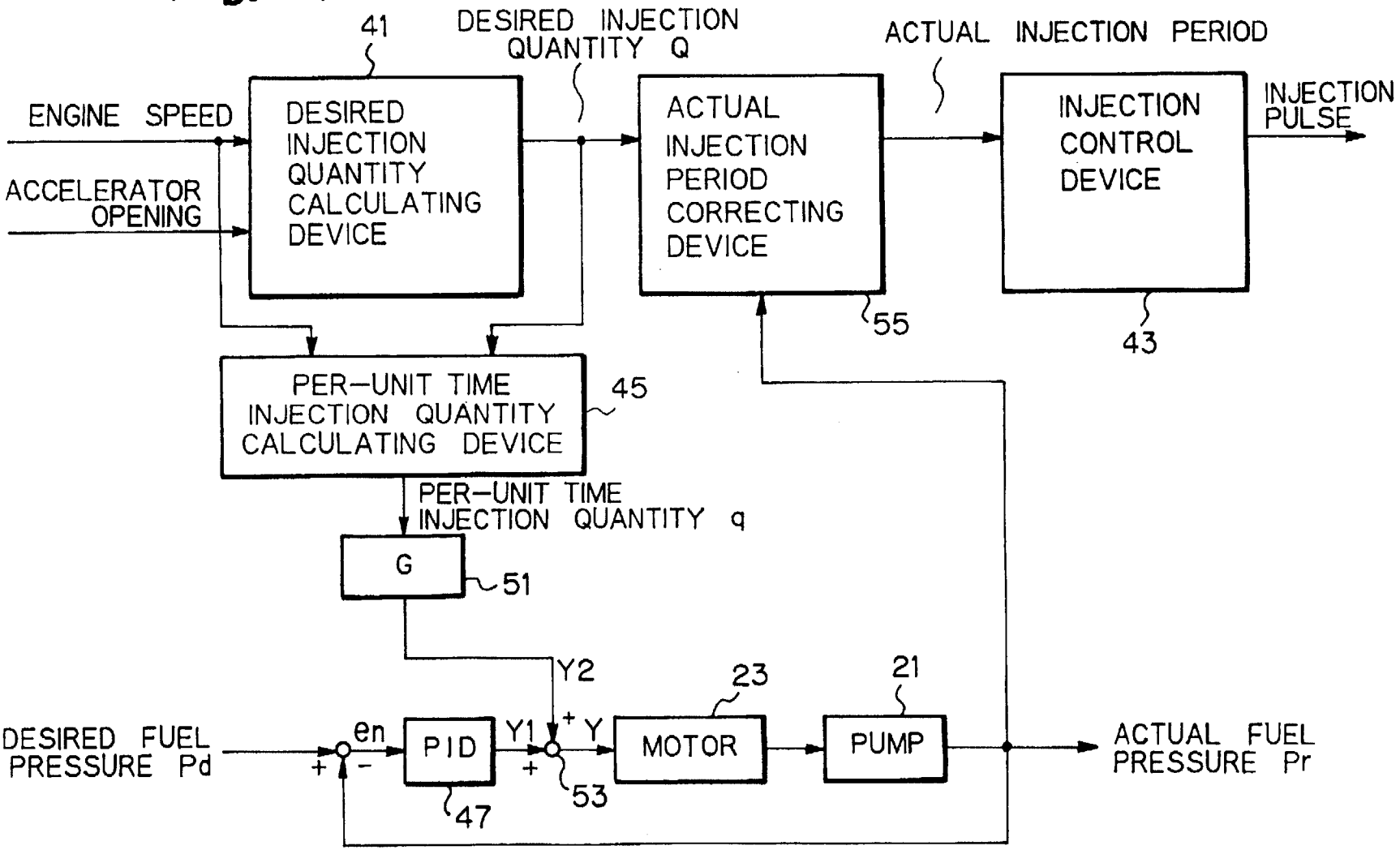
FIG. 14 is a block diagram showing a fifth embodiment of the present invention.
Figure 15:
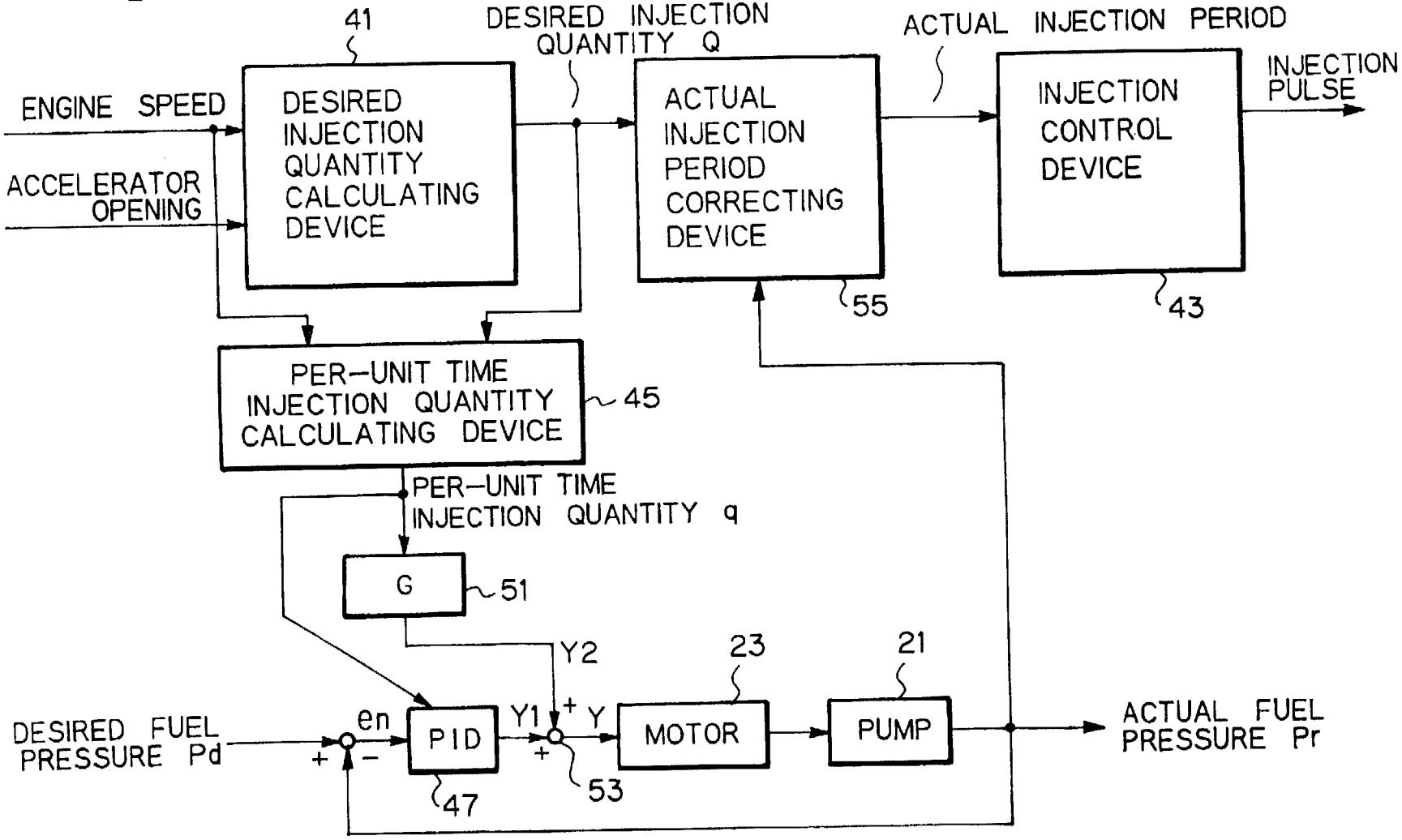
FIG. 15 is a block diagram showing a sixth embodiment of the present invention.
Figure 16:
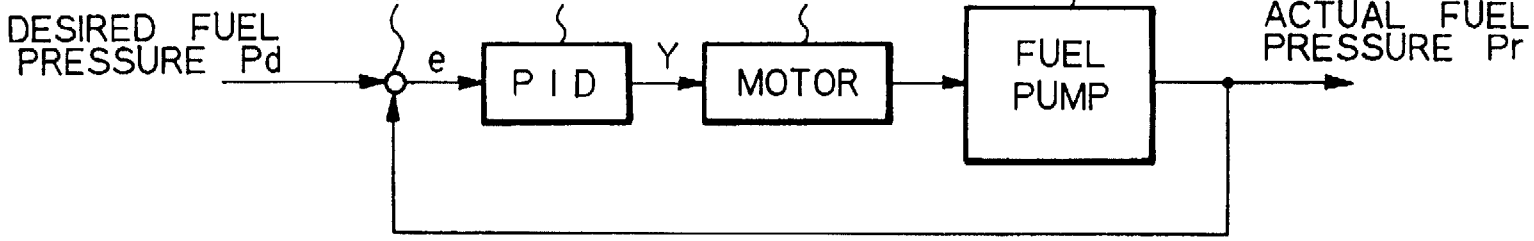
Fig. 16 PRIOR ART
FIG. 16 is a block diagram showing one example of conventional technique.
Figure 17A:
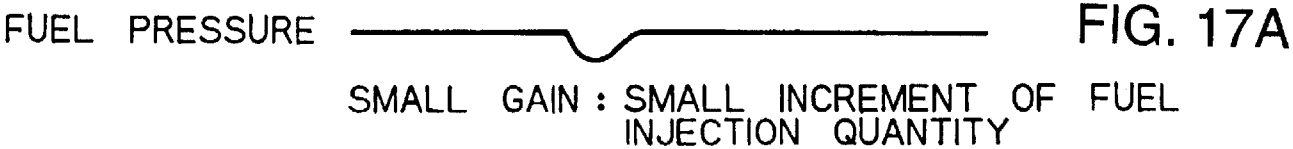
FIGS. 17A–17D are a set of charts showing the results of fuel pressure control by the conventional technique shown in FIG. 16.
Figure 17B:
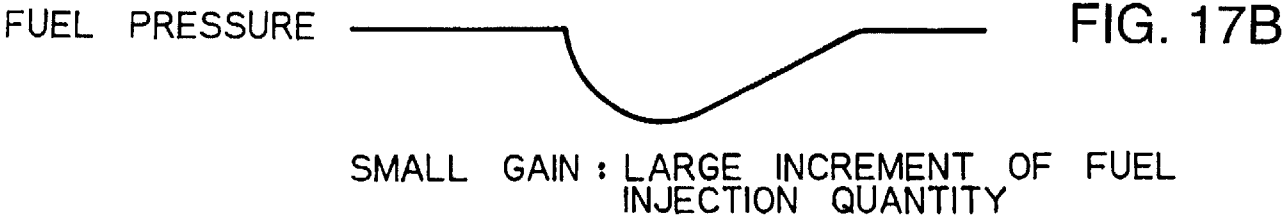
Figure 17C:
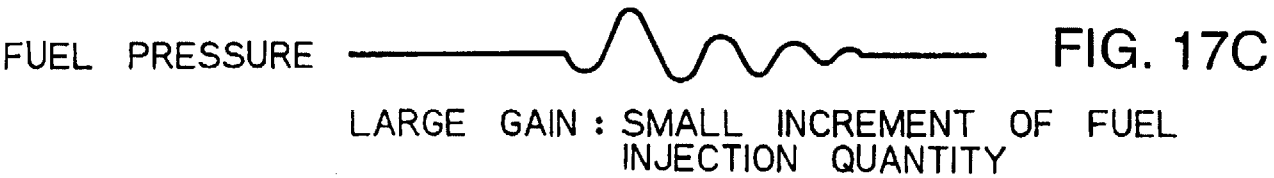
Figure 17D:
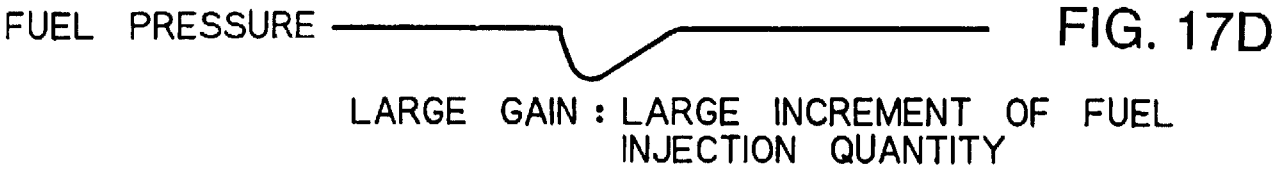

FIGS. 14 and 15 are block diagrams respectively showing the arrangements of fifth and sixth embodiments. The fifth embodiment is formed by incorporating the injection control described in regard to the fourth embodiment into the second embodiment. The sixth embodiment is formed by incorporating the injection control in the fourth embodiment into the third embodiment. Fuel pressure control carried out in the fifth embodiment is the same as that in the second embodiment, and fuel pressure control in the sixth embodiment is the same as that in the third embodiment. Injection control carried out in both the fifth and sixth embodiments is the same as that described in regard to the fourth embodiments. Therefore, detailed description of the fifth and sixth embodiments is omitted.

As has been described above, the high-pressure fuel injection system according to the present invention is provided with a device for calculating an injection quantity per unit time from the desired injection quantity and the engine speed. An input which is to be given to the motor is corrected by a motor input correcting device according to the value of the calculated per-unit time injection quantity. More specifically, for example, the gain factors of the PID controller are corrected by a gain correcting device, thereby indirectly correcting an input, that is, a manipulated variable, which is to be given from the PID controller to the motor, or the manipulated variable is directly corrected by a PID output correcting device, as has been explained in the foregoing embodiments. Accordingly, it is possible to input an optimum manipulated variable to the motor according to the per-unit time injection quantity. Thus, the responsivity of the motor can be optimized independently of the per-unit time injection quantity and independently of the amount of change of the per-unit time injection quantity, and the fuel pressure fluctuation can be minimized. Consequently, there is no particle size variation of fuel injected, and optimum combustion can be obtained. Thus, it becomes possible to make the exhaust gas clean. In a case where the injector injection period, which is obtained from the desired injection quantity, is corrected on the basis of the actual fuel pressure, it is possible to minimize the error of the actually injected fuel quantity from the desired injection quantity irrespective of the fuel pressure fluctuation. Accordingly, the desired air-fuel ratio can be attained.

What is claimed is:

1. A high-pressure fuel injection system, comprising:

a fuel injection unit including an injector;

a fuel pump for supplying a high-pressure fuel to said fuel injection unit;

a motor for driving said fuel pump;

a PID controller for controlling operation of said motor;

means for measuring actual fuel pressure in said fuel injection unit;

means for calculating deviation of said actual fuel pressure from a predetermined desired fuel pressure and for inputting said deviation to said PID controller as an actuating signal;

means for calculating a desired fuel injection quantity per injection from input signals indicating engine speed and accelerator opening;

means for calculating an injection quantity per unit time on the basis of said desired injection quantity; and means for correcting gain factors of said PID controller on the basis of said calculated per-unit time injection quantity.

2. A high-pressure fuel injection system, comprising:

a fuel injection unit including an injector;

a fuel pump for supplying a high-pressure fuel to said fuel injection unit;

a motor for driving said fuel pump;

a PID controller for controlling operation of said motor;

means for measuring actual fuel pressure in said fuel injection unit;

means for calculating deviation of said actual fuel pressure from a predetermined desired fuel pressure and for inputting said deviation to said PID controller as an actuating signal;

means for calculating a desired fuel injection quantity per injection from input signals indicating engine speed, and accelerator opening;

means for calculating an injection quantity per unit time on the basis of said desired injection quantity; and means for correcting output delivered from said PID controller to said motor by calculating a correction quantity on the basis of said calculated per unit-time injection quantity and adding said correction quantity to the output from the PID controller.

3. A method of injecting high-pressure fuel where a fuel pump is driven by a motor to supply fuel placed under high pressure to an injector so that a desired amount of fuel placed high pressure is injected from the injector, comprising:

calculating a desired fuel injection quantity per injection based on signals indicating engine speed and accelerator opening;

measuring actual fuel pressure injected from the injector;

calculating deviation of said actual fuel pressure from a predetermined desired fuel pressure and inputting said deviation as an actuating signal to a PID controller for controlling an operation of said motor;

calculating an injection quantity per unit time on the basis of said desired injection quantity; and correcting gain factors of said PID controller on the basis of said calculated per-unit time injection quantity.

4. A method of injecting high-pressure fuel where a fuel pump is driven by a motor to supply fuel placed under high pressure to an injector so that a desired amount of fuel placed high pressure is injected from the injector, comprising:

calculating a desired fuel injection quantity per injection based on signals indicating engine speed, and accelerator opening;

measuring actual fuel pressure injected from the injector;

calculating deviation of said actual fuel pressure from a predetermined desired fuel pressure and inputting said deviation as an actuating signal to a PID controller for controlling an operation of said motor;

calculating an injection quantity per unit time on the basis of said desired injection quantity; and correcting said output outputted from said PID controller to said motor by adding a correction quantity calculated on the basis of said calculated per-unit time injection quantity.

5. A high-pressure fuel injection system according to claim 1, wherein said motor input correcting means further includes means for correcting an output delivered from said PID controller by calculating a correction quantity on the basis of said calculated per-unit time injection quantity and adding said correction quantity to the output from said PID controller.

6. A high-pressure fuel injection system according to any one of claims 1 to 4, further comprising:

injection control means for controlling an injection period of said injector according to said desired injection quantity, and actual injection period correcting means for correcting said injection period of said injector on the basis of the actual fuel pressure in said fuel injection unit measured by said pressure measuring means, thereby obtaining a corrected actual injection period, said injection control means controlling said injector on the basis of said corrected actual injection period.

7. A high-pressure fuel injection system according to claim 1, wherein said means for correcting gain factors of said PID controller correct the gain factors so that the gain factors increase, respectively, as the per-unit time injection quantity increases.

8. A high-pressure fuel injection system according to claim 6, wherein said gain factors are corrected so as to vary along respective linear lines.

9. A high-pressure fuel injection system according to claim 8, further comprising:

injection control means for controlling an injection period of said injector according to said desired injection quantity, and actual injection period correcting means for correcting said injection period of said injection on the basis of the actual fuel pressure in said fuel injection unit measured by said pressure measuring means, thereby obtaining a corrected actual injection period, said injection control means controlling said injector on the basis of the corrected actual injection period.

10. A high-pressure fuel injection system according to claim 9, wherein said correction quantity increases as said per-unit time injection quantity increases.

11. A high-pressure fuel injection system according to claim 5, further comprising:

injection control means for controlling an injection period for said injector according to said desired injection quantity, and actual injection period correcting means for correcting said injection period of said injection on the basis of the actual fuel pressure in said fuel injection unit measured by said pressure measuring means, thereby obtaining a corrected actual injection period, said injection control means controlling said injector on the basis of the corrected actual injection period.

12. A high-pressure fuel injection system according to claim 2, wherein said correction quantity increases as said per-unit time injection quantity increases.

13. A high-pressure fuel injection system according to claim 2, further comprising:

injection control means for controlling an injection period of said injector according to said desired injection quantity, and actual injection period correcting means for correcting said injection period of said injection on the basis of the actual fuel pressure in said fuel injection unit measured by said pressure measuring means, thereby obtaining a corrected actual injection period, said injection control means controlling said injector on the basis of the corrected actual injection period.

14. A high-pressure fuel injection system according to claim 6, wherein said actual injection period correcting means calculates a correction factor by which said desired injection period is multiplied.

15. A high-pressure fuel injection system according to claim 14, wherein said correction factor increases as said actual pressure reduces.

16. A high-pressure fuel injection system according to claim 15, wherein said correction factor changes along with a linear line.

17. A high-pressure fuel injection system according to claim 16, wherein said correction factor assumes the value 1 when the actual fuel pressure is 5 megapascal.

* * * * *